US011752408B2

(12) United States Patent
Zhang

(10) Patent No.: US 11,752,408 B2
(45) Date of Patent: Sep. 12, 2023

(54) ASSEMBLABLE STAND GOLF BAG

(71) Applicant: Dongguan Sanjiu Sports Products, Ltd., Guangdong (CN)

(72) Inventor: Aiping Zhang, Guangdong (CN)

(73) Assignee: Dongguan Sanjiu Sports Products, Ltd., Dongguan (CN)

( * ) Notice: Subject to any disclaimer, the term of this patent is extended or adjusted under 35 U.S.C. 154(b) by 29 days.

(21) Appl. No.: 17/564,425

(22) Filed: Dec. 29, 2021

(65) Prior Publication Data

US 2022/0241659 A1 Aug. 4, 2022

(30) Foreign Application Priority Data

Feb. 4, 2021 (CN) ..... 202110151874.7

(51) Int. Cl.

| | |
|---|---|
| ***A63B 55/57*** | (2015.01) |
| ***A63B 55/30*** | (2015.01) |
| ***A63B 55/40*** | (2015.01) |
| *A63B 102/32* | (2015.01) |

(52) U.S. Cl.

CPC ..... *A63B 55/57* (2015.10); *A63B 55/30* (2015.10); *A63B 55/40* (2015.10); *A63B 2102/32* (2015.10); *A63B 2225/093* (2013.01)

(58) Field of Classification Search

CPC ..... A63B 55/57; A63B 55/30; A63B 55/40; A63B 2102/32; A63B 2225/093

See application file for complete search history.

(56) References Cited

U.S. PATENT DOCUMENTS

| | | | | |
|---|---|---|---|---|
| 4,378,039 | A * | 3/1983 | Suk | A63B 55/00 206/315.8 |
| 4,448,305 | A * | 5/1984 | Sup | A63B 55/40 206/315.8 |
| 5,482,160 | A * | 1/1996 | Perrin | A63B 55/40 135/125 |
| 2004/0182726 | A1* | 9/2004 | Wang | A63B 55/00 206/315.3 |
| 2006/0118441 | A1* | 6/2006 | Cheng | A63B 55/40 206/315.7 |
| 2014/0034527 | A1* | 2/2014 | Anderson | A63B 55/40 206/315.6 |

* cited by examiner

*Primary Examiner* — Kimberly T Wood

(57) ABSTRACT

The present invention provides an assemblable stand golf bag capable of being assembled and disassembled autonomously by a consumer. The assemblable stand golf bag comprises: a bag body and a support structure assembly for opening and keeping the bag body in an open state, disposed in the bag body, where the bag body includes a bag main body, a head frame connected to a top of the bag main body, a base connected to a bottom of the bag main body, and a guide structure for fixing a mounting track of the support structure assembly. By providing the detachable support structure assembly, the stand golf bag may be stored and transported in a compressed form, so that production and sales costs are greatly saved. By providing the guide structure, it is very convenient for the consumer to autonomously assemble the golf bag.

6 Claims, 17 Drawing Sheets

ASSEMBLABLE STAND GOLF BAG

CROSS REFERENCE TO RELATED APPLICATIONS

The present application claims the benefit of Chinese Patent Application No. 202110151874.7 filed on Feb. 4, 2021, the contents of which are incorporated herein by reference in their entirety.

FIELD OF TECHNOLOGY

The present invention relates to the technical field of stand golf bags, in particular, to a stand golf bag capable of being assembled and disassembled autonomously by a consumer.

BACKGROUND

With the continuous improvement of people's living standards, requirements for quality of life are also increased accordingly. Consequently, a quantity of people who use rest days for leisure, tourism, and sports is also increased rapidly. Nowadays, one of the hottest sports in outdoor leisure sports is golf, and the golf gradually becomes a widespread sport from an early aristocratic sport, and becomes a sport that increasingly more people like.

There are two main types of golf bags on the current market, one type is an oblique stand golf bag, and the other type is a stand golf bag. The oblique stand golf bag is shown in FIG. 1 and FIG. 2, the oblique stand golf bag 3 obliquely stands on a ground by laying support legs 31 when being used, and the support legs 31 are retracted when being not used. The oblique stand golf bag 3 has two advantages. One advantage is that it is convenient to place the golf bag on an uneven ground for use, for example, grass; and the other advantage is that because the golf bag obliquely stands when being used, it is relatively convenient to take and place golf clubs. The oblique stand golf bag also has relatively obvious advantages. First, due to a requirement of the stability of oblique standing, the oblique stand golf bag has a relatively complex structure.

The stand golf bag is shown in FIG. 3 and FIG. 4. The stand golf bag 4 always stands upright on the ground regardless of whether it is in use or not in use. Because the stand golf bag does not have a function of obliquely standing on the uneven ground, the stand golf bag has a simpler structure than the oblique stand golf bag. Moreover, because the stand golf bag 4 may be equipped with four universal rollers 41 at a bottom, the stand golf bag 4 may stand upright on the ground and be pushed for carry, or may be obliquely dragged on the ground for carry. The portability of the stand golf bag far exceeds that of the oblique stand golf bag.

However, the stand golf bag occupies a very large space, and for a procedure and a seller, such a large space makes storage and transportation costs so high.

SUMMARY

An objective of the present invention is to overcome the foregoing disadvantages in the prior art, and therefore an assemblable stand golf bag is provided.

To achieve the foregoing objective, the following technical solution is used in the present invention: An assemblable stand golf bag is provided, including a bag body and a support structure assembly disposed in the bag body, where the support structure assembly is used for opening the bag body and keeping the bag body in an open state, the bag body includes a head frame, a bag main body, and a base, the head frame is connected to a top of the bag main body, the base is connected to a bottom of the bag main body, the support structure assembly is detachably mounted in the bag body, and the bag body is further provided with a guide structure, and the guide structure is used for fixing a mounting track of the support structure assembly.

Further, in the foregoing solution, the support structure assembly includes a support rod, the head frame is provided with a through groove for the support rod to pass through, and a closed groove capable of accommodating an end portion of the support rod is provided at a position of the base corresponding to the through groove of the head frame.

Further, in the foregoing solution, the support structure assembly includes a support rod, the base is provided with a through groove for the support rod to pass through, and a closed groove capable of accommodating an end portion of the support rod is provided at a position of the head frame corresponding to the through groove of the base.

Further, in the foregoing solution, the guide structure is a flow guide tube disposed between the through groove and the closed groove, the flow guide tube is made of cloth or a soft material, and is a strip-shaped hollow channel, the hollow channel is capable of accommodating the support rod to pass through, one end of the flow guide tube is fixedly sleeved outside the through groove, and the other end is fixedly sleeved inside the closed groove.

Further, in the foregoing solution, there are four support rods, there are four through grooves, there are four closed grooves, and there are four flow guide tubes.

Further, in the foregoing solution, a locking structure is further disposed between the support rod and the through groove, and when one end of the support rod passes through the through groove and is inserted into the closed groove, the locking structure fixes the other end of the support rod to a relative position of the through groove.

Further, in the foregoing solution, the locking structure is an external thread disposed inside the through groove and an internal thread disposed outside one end of the support rod.

Further, in the foregoing solution, a locking drive groove is further provided at a port of one end at which the support rod is provided with the internal thread.

Further, in the foregoing solution, the support rod has a first form and a second form that are switchable, and when the support rod is in the first form, the support rod is folded; and when the support rod is in the second form, end portions of two folded parts of the support rod are connected to increase a rod length.

Further, in the foregoing solution, the support rod includes a first rod portion, a second rod portion, and an elastic rope, a hollow socket is fixedly disposed at one end of the first rod portion, the socket is capable of accommodating an end portion of the second rod portion, a hollow channel for the elastic rope to pass through is provided inside both shafts of the first rod portion and the second rod portion, the elastic rope is disposed in the hollow channel, one end of the elastic rope is fastened to a port of the first rod portion away from the socket, and the other end is fastened to a port of the second rod portion away from the socket.

A manner of a detachable support structure is used in the present invention, to compress the volume of the stand golf bag during storage and sale, so that storage and transportation costs of a producer and a seller are greatly saved, and due to an arrangement of the guide structure, it is also very convenient for a consumer to autonomously assemble the golf bag.

DESCRIPTION OF REFERENCE NUMERALS

| | |
|---|---|
| 1 | bag body |
| 11 | head frame |
| 111 | closed groove |
| 12 | bag main body |
| 13 | base |
| 131 | through groove |
| 14 | flow guide tube |
| 2 | support rod |
| 21 | first rod portion |
| 211 | socket tube |
| 212 | locking portion |
| 2121 | hexagonal drive groove |
| 22 | second rod portion |
| 23 | elastic rope |
| 3 | oblique stand golf bag |
| 31 | support leg |
| 4 | stand golf bag |
| 41 | universal roller |

DESCRIPTION OF THE EMBODIMENTS

The concept, the specific structure, and the generated technical effects of the present invention are further described below with reference to the accompanying drawings, to fully understand the objective, features, and effects of the present invention.

It should be noted that in the description of the present invention, directions or position relationships indicated by terms such as "surface layer", "top end", "edge" and "inner side" are based on directions or position relationships shown in the accompanying drawings, and are merely used for description, rather than indicating or implying that the apparatuses or components should have a particular orientation or be constructed and operated in a particular orientation. Therefore, such terms cannot be understood as a limitation on the present invention.

Figure 1:
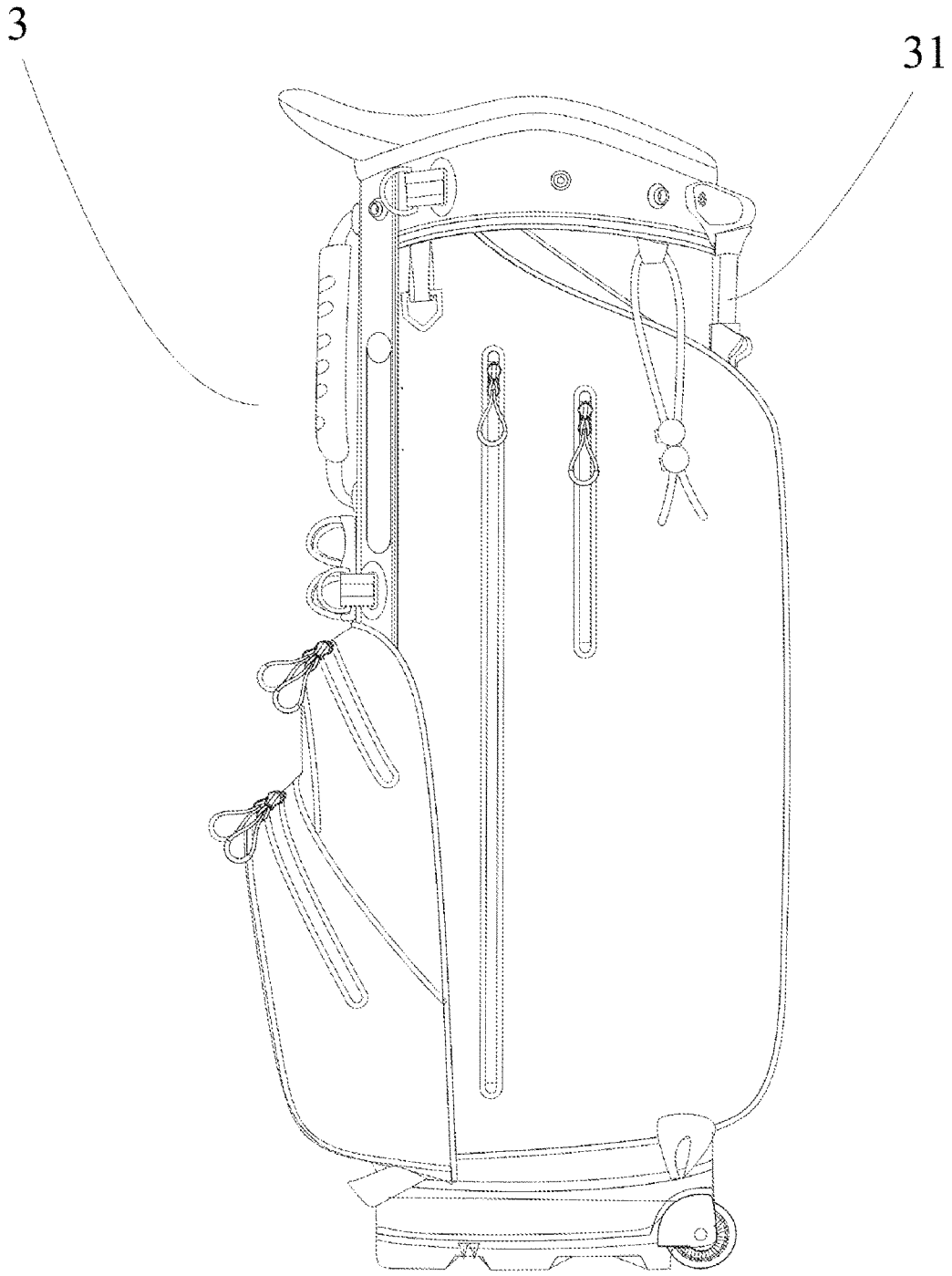
FIG. 1 is a side view of an oblique stand golf bag in a folded state in the background art.
Figure 2:
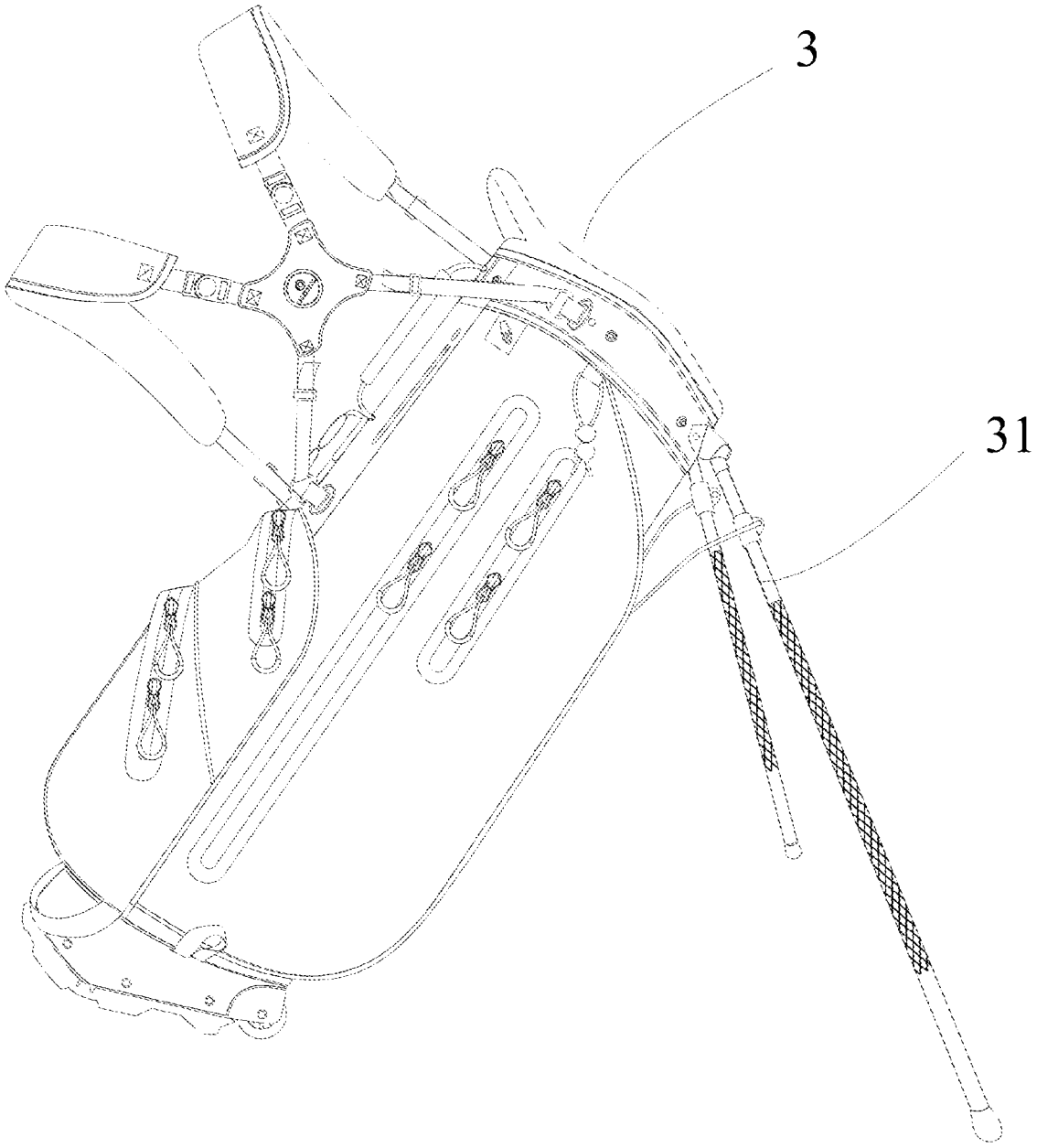
FIG. 2 is a side view of an oblique stand golf bag in an unfolded state in the background art.
Figure 3:
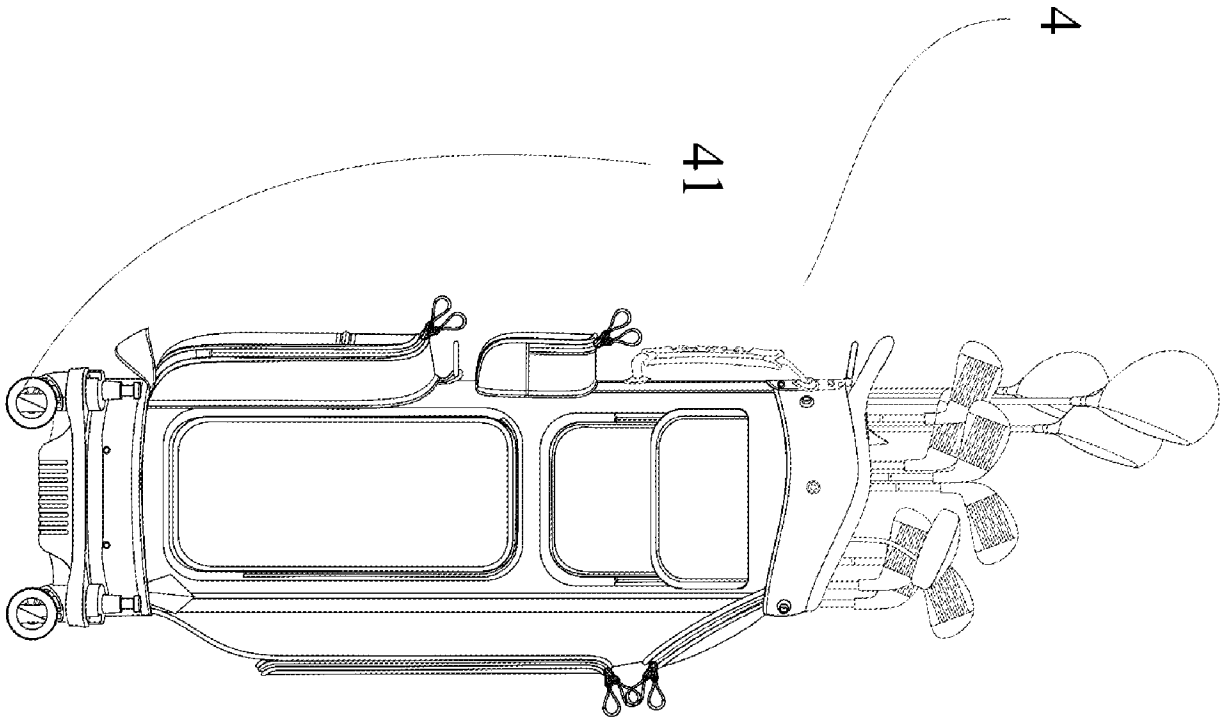
FIG. 3 is a side view of a stand golf bag in the background art.
Figure 4:
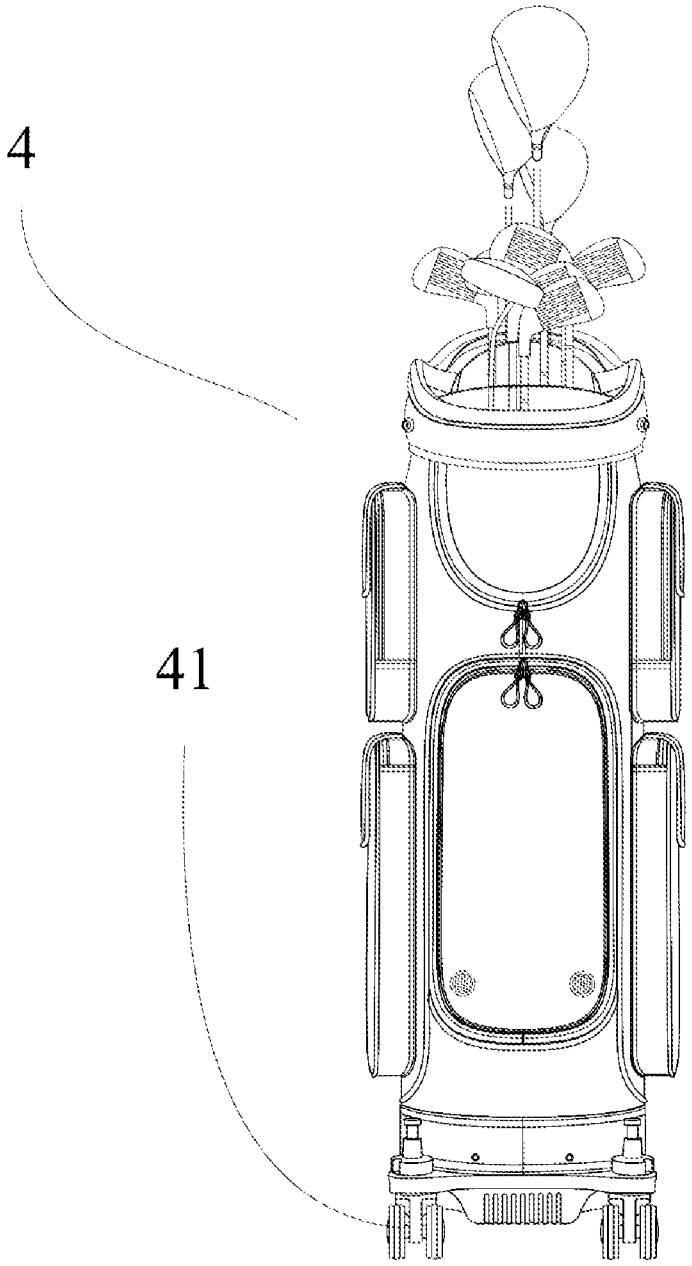
FIG. 4 is a front view of a stand golf bag in the background art.
Figure 5:
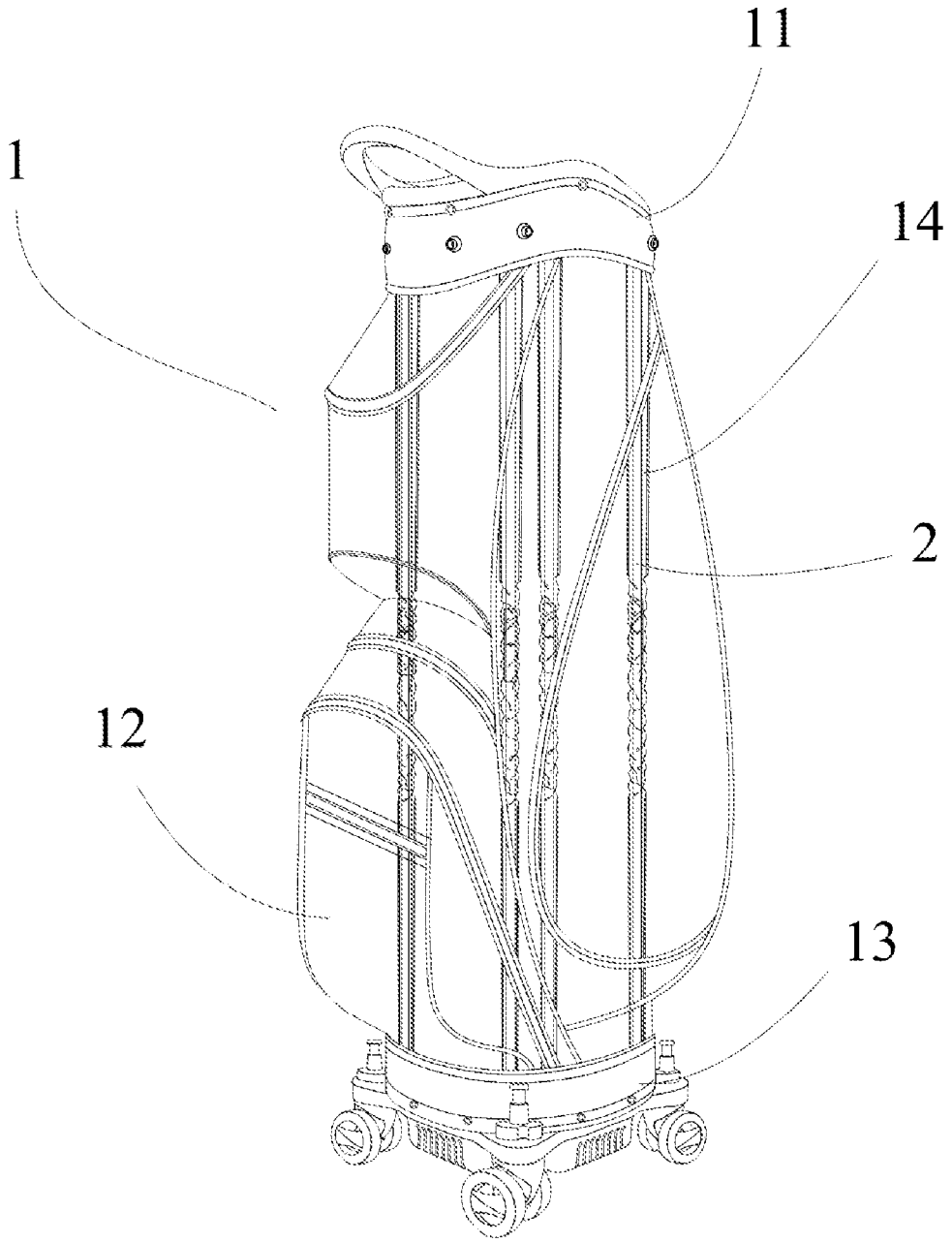
FIG. 5 is a perspective view of a three-dimensional (3D) structure in an embodiment of the present invention.
Figure 6:
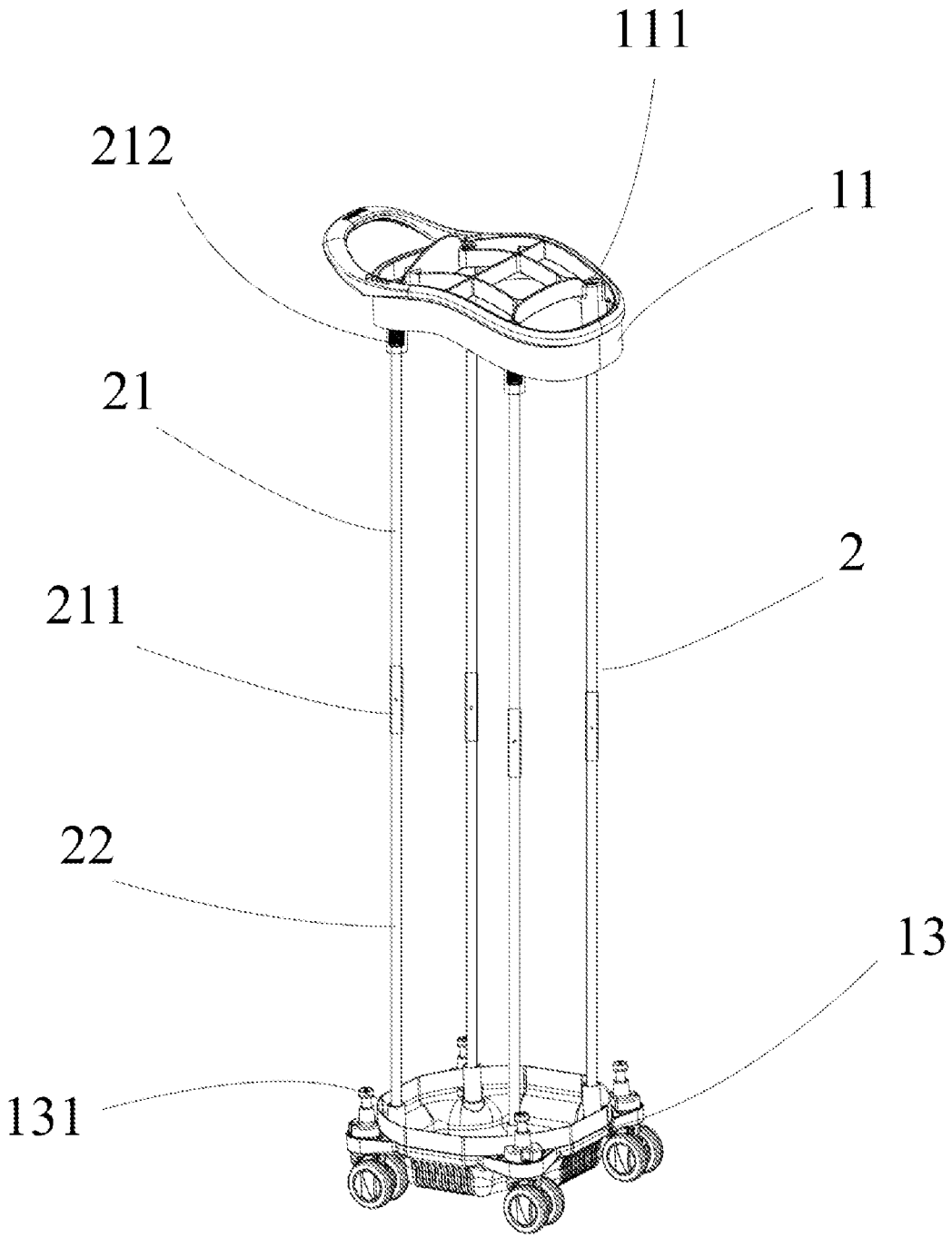
FIG. 6 is a schematic 3D diagram of a connection relationship among a head frame, a support rod, and a base in an embodiment of the present invention.

As shown in FIG. 5 and FIG. 6, an assemblable stand golf bag is provided, including a bag body 1 that functions as a covering surface. The bag body 1 includes a head frame 11, a bag main body 12, a base 13, and a flow guide tube 14. The head frame 11 is disposed at a top of the bag main body 12, the base 13 is disposed at a bottom of the bag main body 12, the flow guide tube 14 is disposed inside the bag main body 12 and is separately connected to the head frame 11 and the base 13, and a detachable support rod 2 is further inserted inside the flow guide tube 14.

Figure 7:
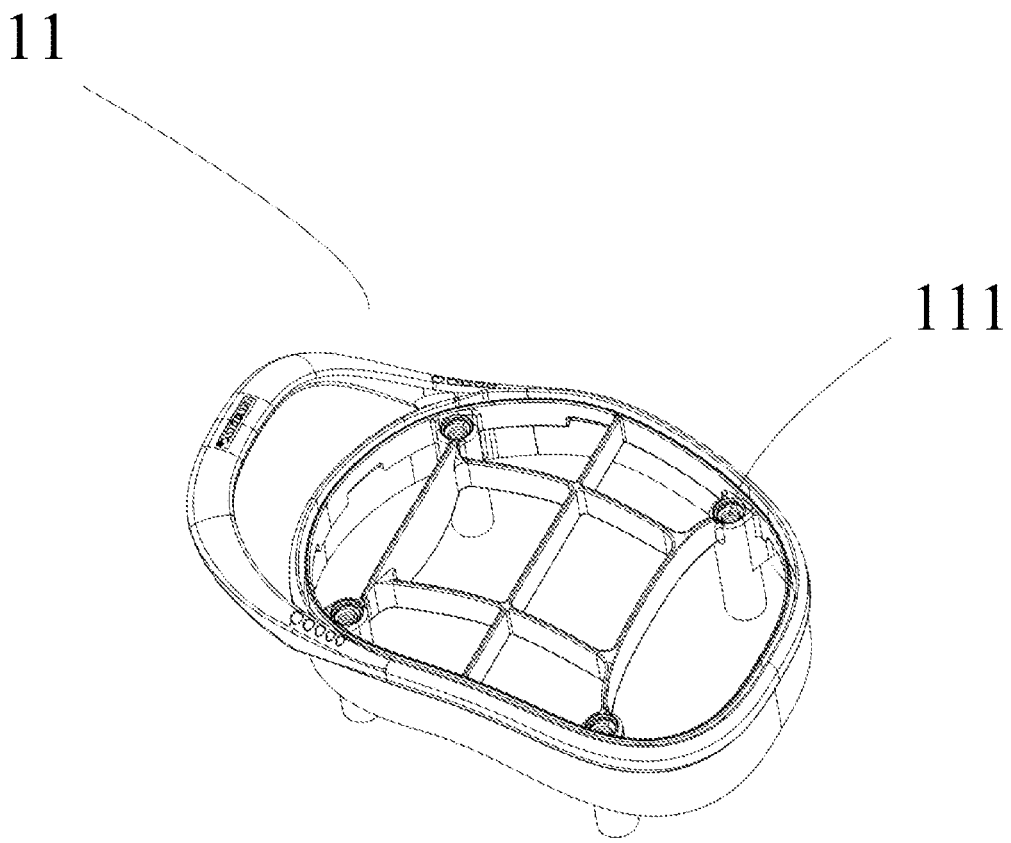
FIG. 7 is a schematic diagram of a 3D structure of a head frame in an embodiment of the present invention.
Figure 8:
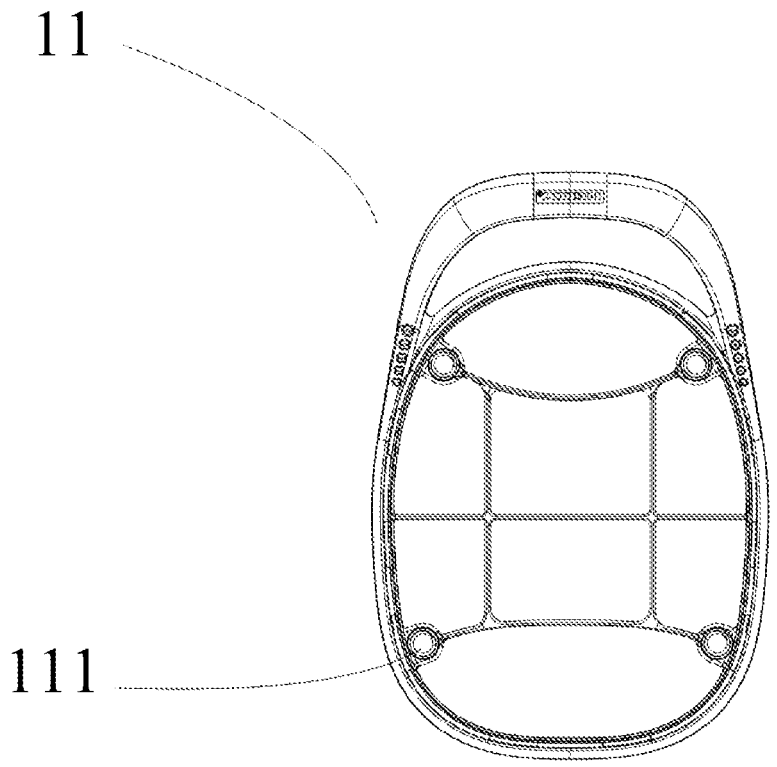
FIG. 8 is a top view of a head frame in an embodiment of the present invention.

As shown in FIG. 7 and FIG. 8, four hollow through grooves 111 with internal threads are evenly distributed near an edge of the head frame 11, and the through groove 111 is used for being passed through and locking the support rod 2.

Figure 9:
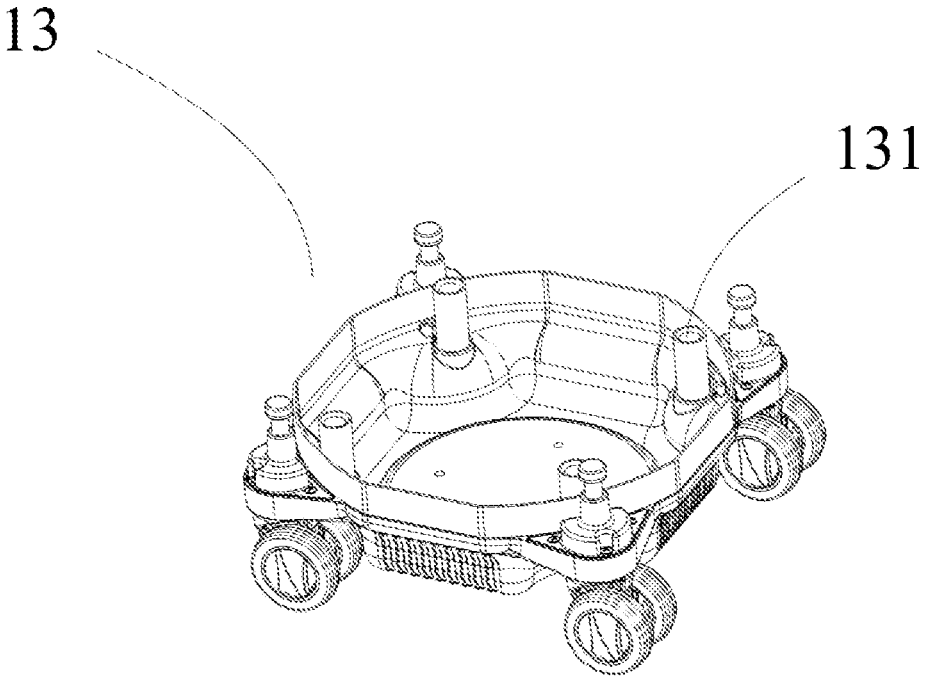
FIG. 9 is a schematic diagram of a 3D structure of a base in an embodiment of the present invention.
Figure 10:
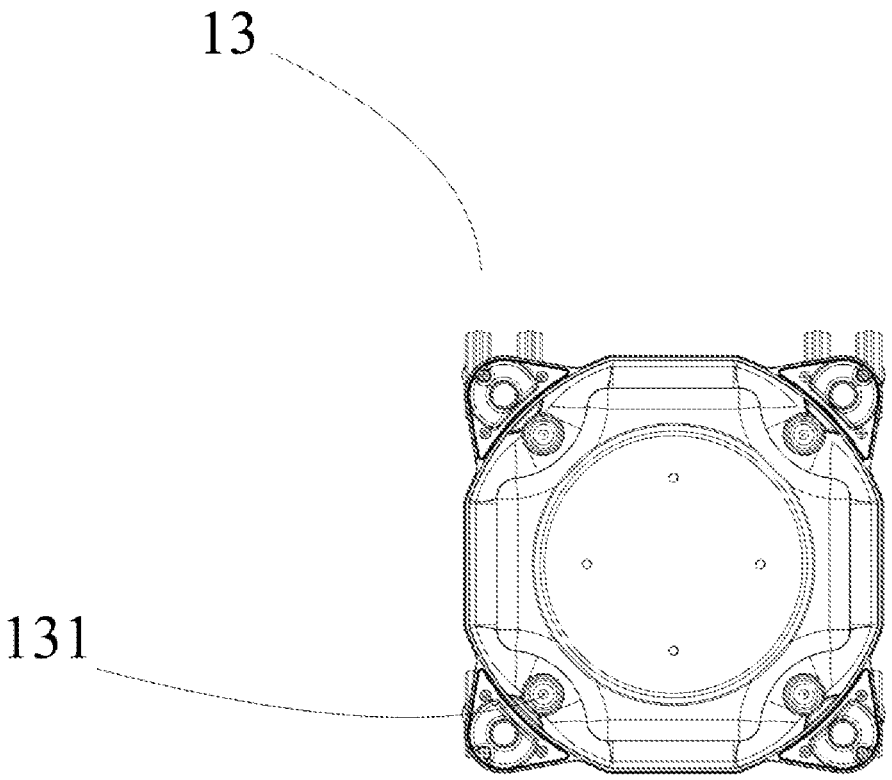
FIG. 10 is a top view of a base in an embodiment of the present invention.

As shown in FIG. 9 and FIG. 10, four closed grooves 131 are evenly distributed near an edge of the base 13, and the closed groove 131 is used for accommodating one end of the support rod 2.

Figure 11:
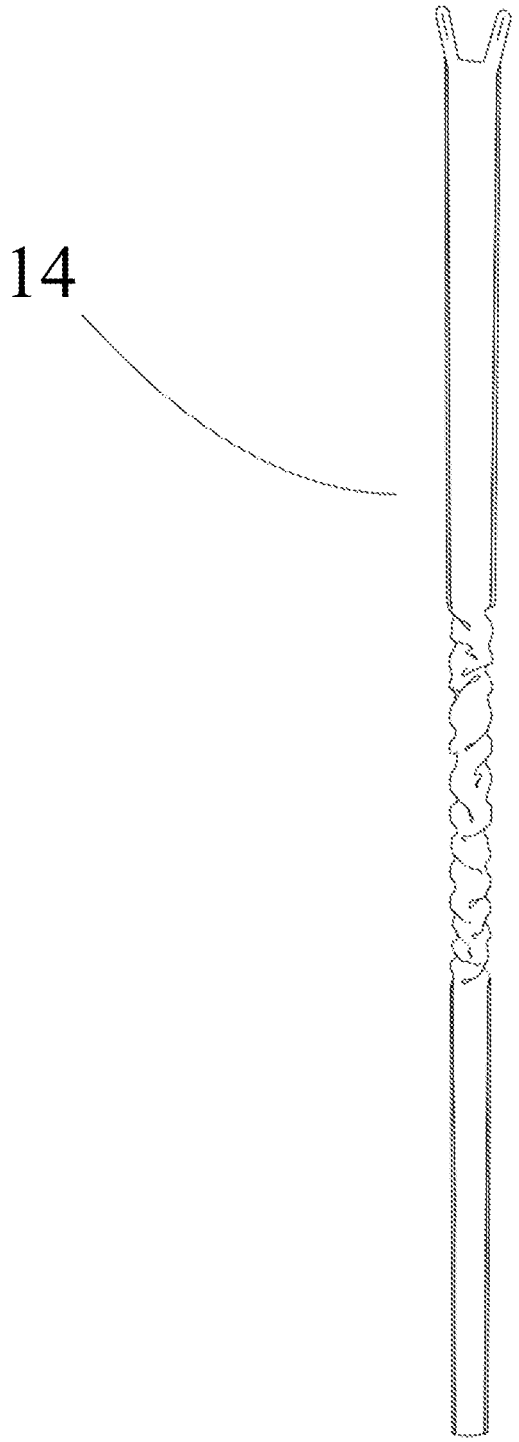
FIG. 11 is a front view of a flow guide tube in an embodiment of the present invention.

As shown in FIG. 11, a relatively large opening is disposed at one end of the flow guide tube 14. The relatively large opening is used for covering an outer side of the through groove 111, and is fixedly connected to the outer side of the through groove 111; and a relatively small opening at the other end of the flow guide tube 14 is used for connecting an inner side of the closed groove 131, and is fixedly connected to the inner side of the closed groove 131.

Figure 12:
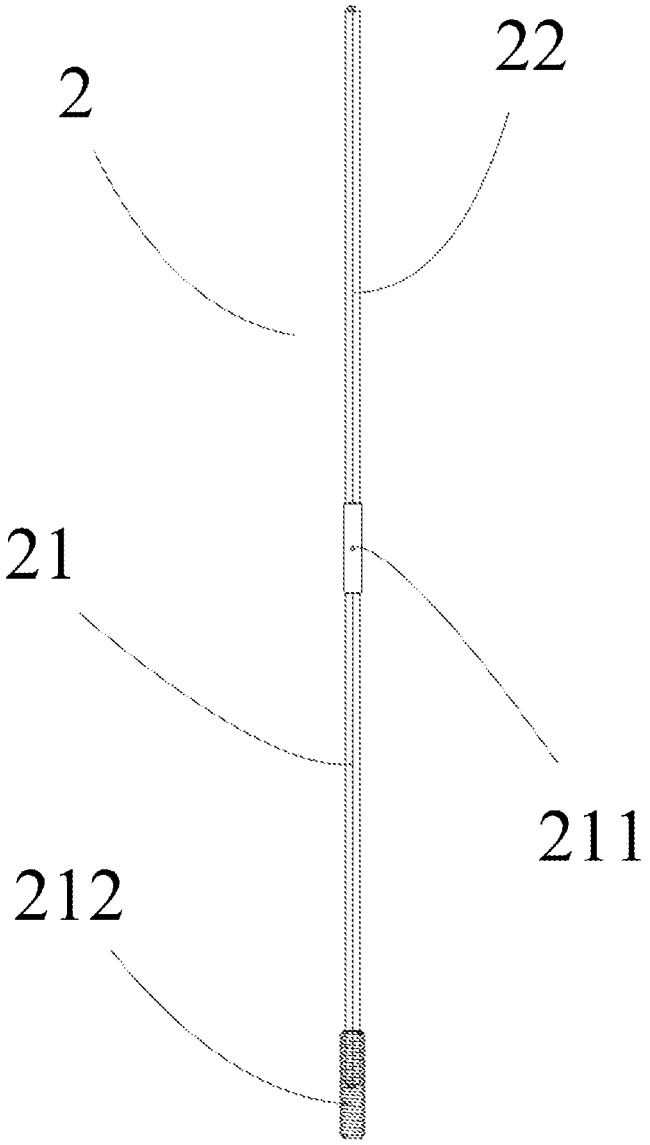
FIG. 12 is a front view of a support rod in a second form in an embodiment of the present invention.
Figure 13:
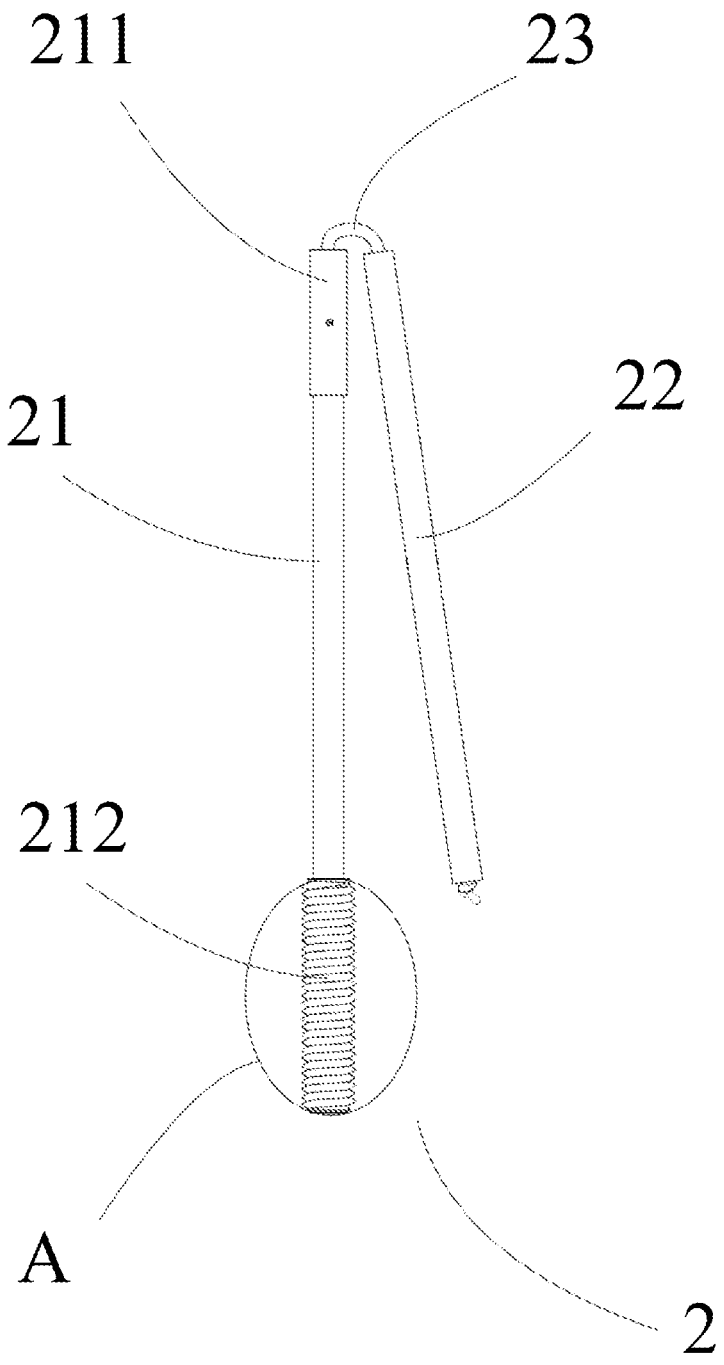
FIG. 13 is a front view of a support rod in a first form in an embodiment of the present invention.
Figure 14:
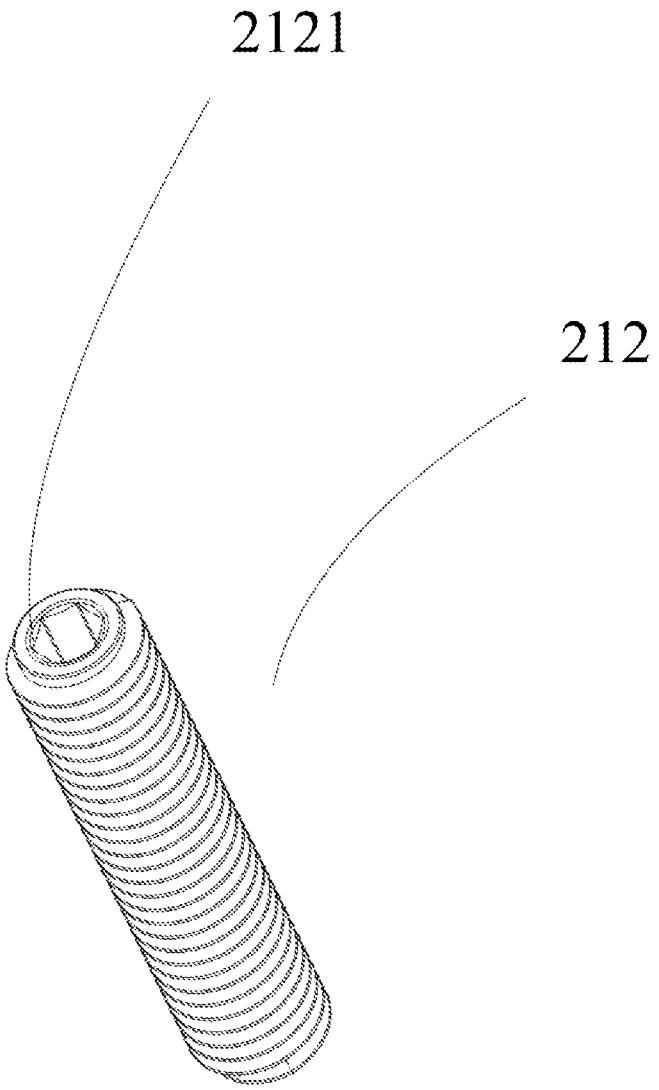
FIG. 14 is a schematic diagram of a 3D structure enlarged at a position A.

As shown in FIG. 12 to FIG. 14, the support rod 2 includes a first rod portion 21, a second rod portion 22, and an elastic rope 23. A socket 211 is fixedly disposed at one end of the first rod portion 21, a locking portion 212 is disposed at the other end, a slot capable of accommodating an end portion of the second rod portion 22 is provided inside the socket 211, an external thread is disposed outside the locking portion 212, and a hexagonal drive groove 2121 is further provided at a port of the locking portion 212; and a hollow channel for the elastic rope 23 to pass through is disposed inside both the first rod portion 21 and the second rod portion 22, one end of the elastic rope 23 is fastened to a port of the first rod portion 21 away from the socket 211, and the other end is fastened to a port of the second rod portion 22 away from the socket 211. When the first rod portion 21 and the second rod portion 22 need to be sleeved together, one end of the second rod portion 22 may be inserted into the socket 211 by using the elasticity of the elastic rope 23. When the first rod portion 21 and the second rod portion 22 need to be separated and folded, the second rod portion 22 is also pulled out from the socket 211 by using the elasticity of the elastic rope 23, and the first rod portion and the second rod portion are then folded.

Figure 15:
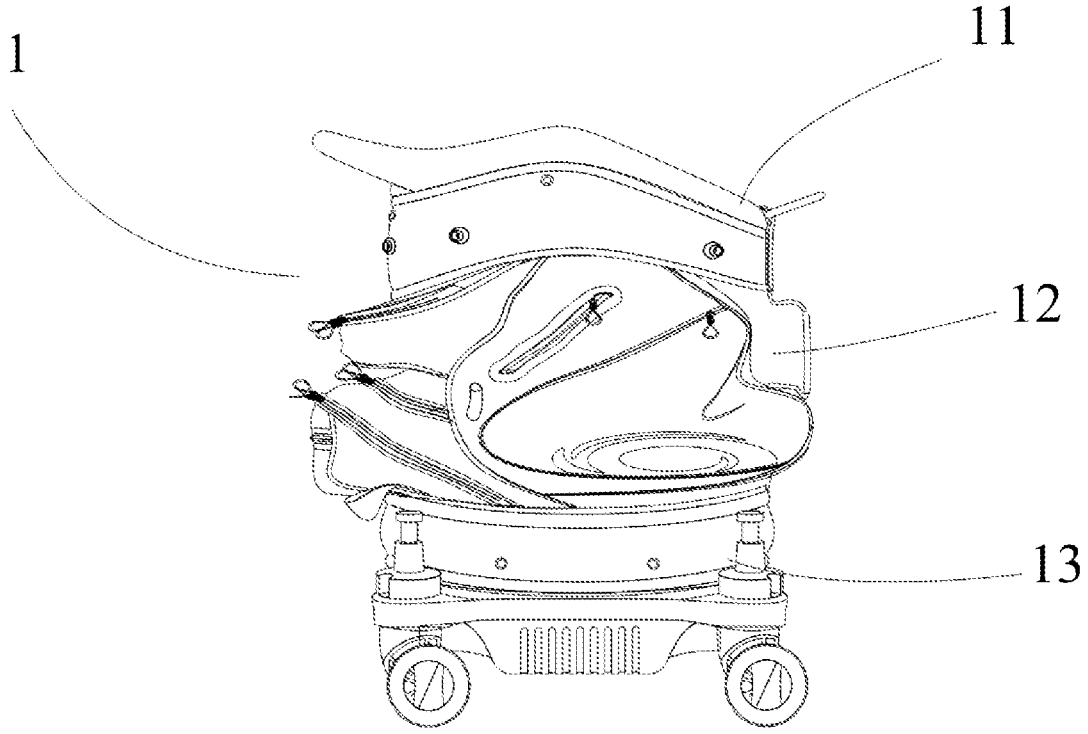
FIG. 15 is a schematic diagram of a compressed form in an embodiment of the present invention.
Figure 16:
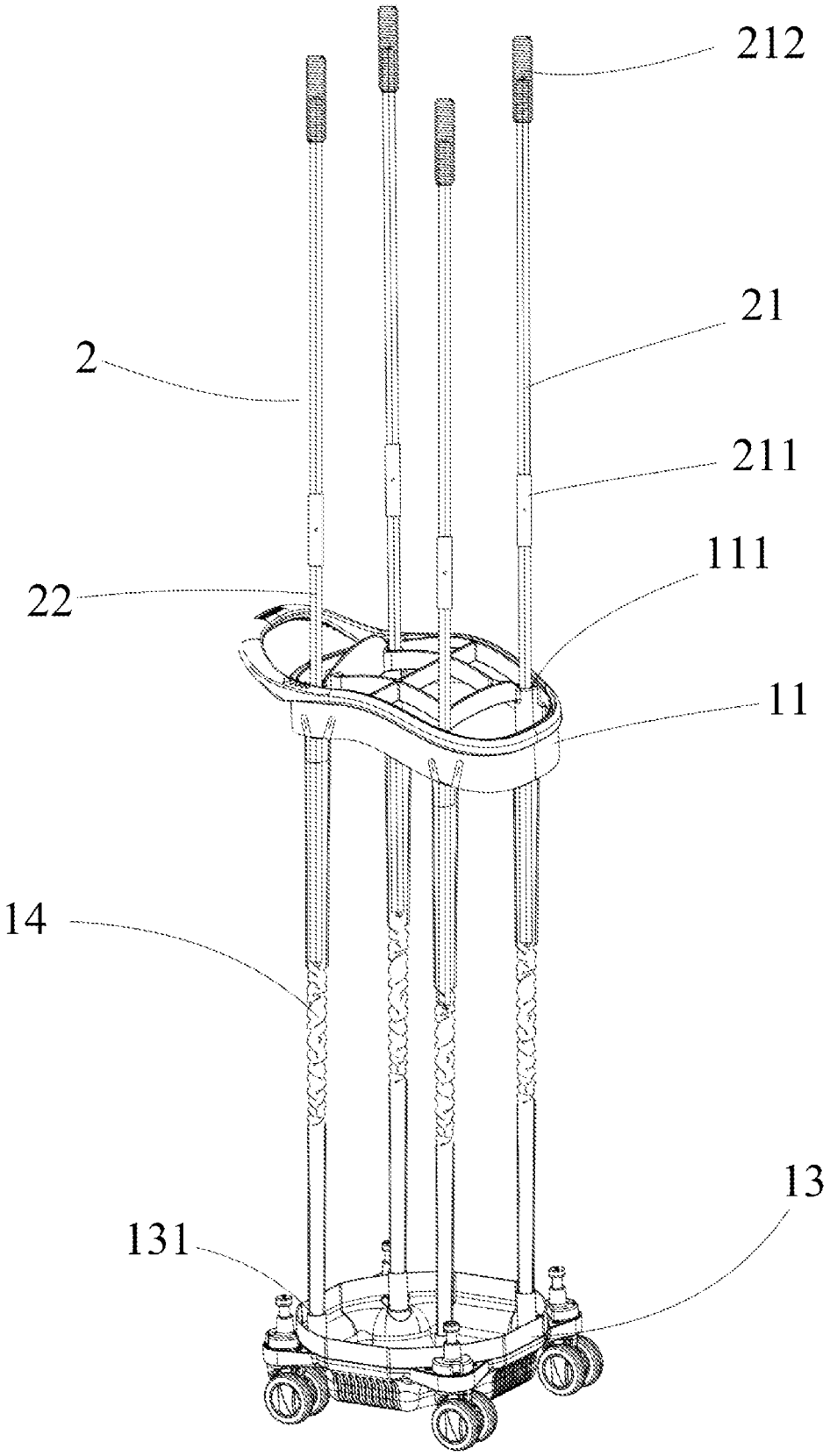
FIG. 16 is a schematic diagram of a 3D structure during assembly in an embodiment of the present invention.
Figure 17:
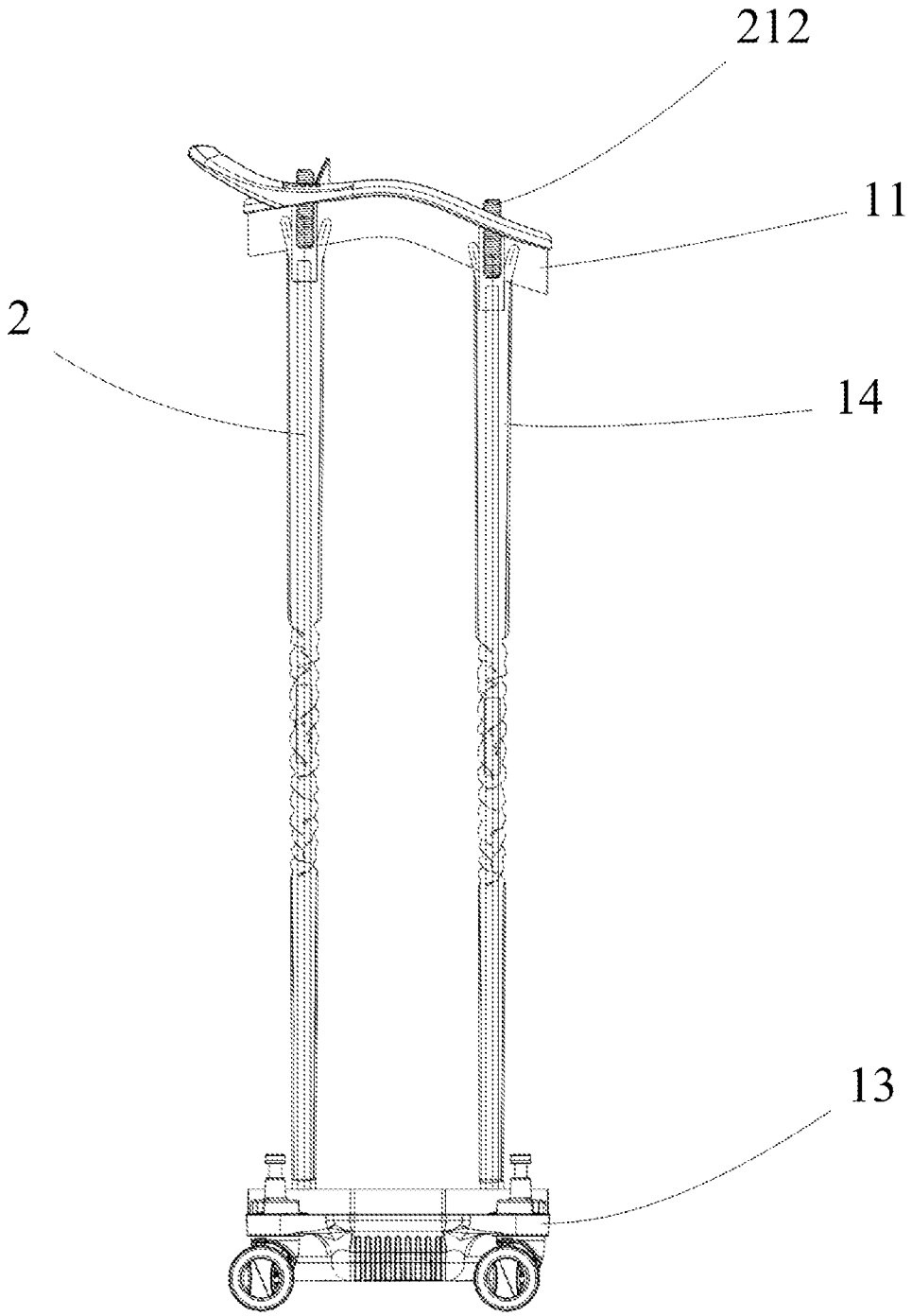
FIG. 17 is a perspective side view during assembly in an embodiment of the present invention.

During implementation of this embodiment, as shown in FIG. 15 to FIG. 17, the bag body 1 in a compressed form is first lift up, and after the first rod portions 21 and the second rod portions 22 of four support rods 2 are then sleeved together, each support rod 2 is inserted in a downward direction of the second rob portion 22 and passes through the through groove 111 in the head frame 11, the support rod 2 that partially passes through the through groove 111 continue to be inserted in a channel direction of the flow guide tube 14 and is finally located the closed groove 131 on the base, one end of the support rod 2 is then fixed with the head frame 11 in a threaded engagement manner by using the locking portion 212 on the first rod portion 21, and the support rod 2 is further fixed with the head frame 11 through a hexagonal drive groove 2121 on the locking portion 212 by using a tool.

In this embodiment, a component with a function of a support structure assembly is the support rod 2, and a component with a function of a guide structure is the flow guide tube 14, and components with a function of a locking structure is the locking portion 212 and the internal thread disposed in the through groove 111.

Through the detachable support structure assembly and the mounting manner in this embodiment, the stand golf bag may be stored and transported in a compressed form before being used, so that production and sales costs are greatly saved, and it is also very simple to perform operations in this embodiment when a consumer autonomously performs assembly.

It should be noted that the foregoing specific implementations are merely preferred embodiments of the present invention and description of the applied technical principles, and any change or substitution easily conceived by those skilled in the art within the technical scope of the present invention shall fall within the protection scope of the present invention.

What is claimed is:

1. An assemblable stand golf bag comprising a bag body, support structure assembly and a guide structure disposed in the bag body; it is characterized in that the bag body comprises a head frame, a bag main body, and a base, the head frame is connected to a top of the bag main body, the base is connected to a bottom of the bag main body, the support structure assembly is detachably mounted in the bag body and used for opening the bag body and keeping the bag body in an open state; the support structure comprises a support rod, the head frame is provided with a through groove for the support rod to pass through, and a closed groove capable of accommodating an end portion of the support rod is provided at a position of the base corresponding to the through groove of the head frame; the support rod comprises a first rod portion, a second rod portion, and an elastic rope, a hollow socket is fixedly disposed at one end of the first rod portion, the socket is capable of accommodating an end portion of the second rod portion, a hollow channel for the elastic rope to pass through is disposed inside both the first rod portion and the second rod portion, the elastic rope is disposed in the hollow channel, one end of the elastic rope is fastened to a port of the first rod portion away from the socket, and other end of the elastic rope is fastened to a port of the second rod portion away from the socket;

the guide structure is a flow guide tube disposed between the through groove and the closed groove, and is a strip-shaped hollow channel, the hollow channel is capable of accommodating the support rod to pass through, one end of the flow guide tube is fixedly sleeved outside the through groove, and the other end is fixedly sleeved inside the closed groove; and there are four support rods, there are four through grooves, there are four closed grooves, and there are four flow guide tubes.

2. The assemblable stand golf bag according to claim 1, wherein the flow guide tube is made of cloth or a soft material.

3. The assemblable stand golf bag according to claim 1, wherein the support rod has a first form and a second form that are switchable, and when the support rod is in the first form, the support rod is folded; and when the support rod is in the second form, end portions of two folded parts of the support rod are connected to increase a rod length.

4. The assemblable stand golf bag according to claim 1, wherein a locking structure is further disposed between the support rod and the through groove, and when one end of the support rod passes through the through groove and is inserted into the closed groove, the locking structure fixes the other end of the support rod to a relative position of the through groove.

5. The assemblable stand golf bag according to claim 4, wherein the locking structure is an internal thread disposed inside the through groove and an external thread disposed outside one end of the support rod.

6. The assemblable stand golf bag according to claim 5, wherein a locking drive groove is further provided at a port of one end at which the support rod is provided with the external thread.

* * * * *